United States Patent [19]

Inukai et al.

[11] Patent Number: 4,520,755

[45] Date of Patent: Jun. 4, 1985

[54] SPRAY TYPE COATING APPARATUS

[75] Inventors: Yuzo Inukai, Shizuoka; Yoshiaki Shichijo, Kanagawa, both of Japan

[73] Assignee: Fuji Photo Film Co., Ltd., Kanagawa, Japan

[21] Appl. No.: 530,170

[22] Filed: Sep. 7, 1983

[30] Foreign Application Priority Data

Sep. 7, 1982 [JP] Japan ..... 57-135660[U]

[51] Int. Cl.[3] ..... B05B 15/04

[52] U.S. Cl. ..... 118/629; 118/325; 118/326; 118/DIG. 7; 118/504

[58] Field of Search ..... 118/326, DIG. 7, 504, 118/325, 629; 98/115 SB; 427/421

[56] References Cited

U.S. PATENT DOCUMENTS 1,746,228 2/1930 Darling ..... 118/326 X
2,403,018 7/1946 Oglesby ..... 118/325
3,513,765 5/1970 Bok ..... 118/326 X

FOREIGN PATENT DOCUMENTS 2531748 2/1977 Fed. Rep. of Germany ..... 118/326
52-104572 2/1977 Japan .

*Primary Examiner*—Shrive P. Beck
*Attorney, Agent, or Firm*—Sughrue, Mion, Zinn, Macpeak, and Seas

[57] ABSTRACT

A spray coating apparatus for spraying paint on a vertically moving web is designed to provide an overspray area on each side of the web. In order to remove the oversprayed paint, a pair of liquid film forming boards are located on both sides of the web. Each liquid film forming board is provided with a cleaning liquid supply device along the top edge thereof and a plurality of parallel vertically extending protrusions thereon for forming a downwardly flowing continuous liquid film for removing the oversprayed paint.

2 Claims, 7 Drawing Figures

SPRAY TYPE COATING APPARATUS

BACKGROUND OF THE INVENTION

The present invention is directed to a spray type coating apparatus in which paint is sprayed on a vertically moving web, and more specifically to means for effectively removing the oversprayed paint on both sides of the moving web.

Previously, an electrostatic coating system was employed in which the material to be coated was coated with paint which was atomized in an electric filed in a coating chamber. In such a system a disk-type, bell-type or gun-type electrostatic coating device was provided in the coating chamber and the materials to be coated were hung on hangers moving along a conveyor rail so that the materials were coated with paint which atomized in the electric field by the apparatus. As a further example, Japanese Patent Application No. 28740/1980 discloses an electrostatic coating method in which a moving web is coated with paint which is atomized in an electric field.

On the other hand, Japanese Laid-Open Patent Application No. 142558/1980 discloses a technique for providing a coating pattern according to an electrostatic coating method wherein, in order to improve a conventional circular or annular pattern, a shield plate to which a high voltage is applied and an air-curtain shaped air flow are utilized so that the coating pattern of the atomizer is rendered eliptical by the electrostatic force and by the force of the air flow. No matter what coating pattern is used, in order to form a coating which has a uniform thickness along both edge portions of the moving web which is being coated with paint according to the electrostatic coating method, the coating pattern must have a width larger than the width of the web. Thus, a considerable amount of overspray liquid occurs on both sides of the web.

Japanese Laid-Open Patent Application No. 104572 discloses a spraying method wherein a belt conveyor is confronted with the peripheral portion of the region to be sprayed so that the belt conveyor receives paint which is sprayed along the peripheral portion so that the peripheral portion is protected from being sprayed with paint. However, such a method is disadvantageous in that the equipment is intricate and expensive. In addition, when a moving web is being continuously coated, the overspray liquid causes the edge portion of the web to be thick coated and the paint has a tendency to flow over the rear surface of the web. Since no means are provided against the troubles which may occur when a moving web curls or flutters, the above-described difficulties relating to the thick coated edges are not sufficiently eliminated.

SUMMARY OF THE INVENTION

The present invention provides a new and improved spray type coating apparatus which is simple in construction and operation and which ovecomes all of the aforementioned difficulties.

The present invention provides a new and improved spray type coating apparatus in which the spray coating operation is extremely stable and reliable for a long period of time, thereby providing a uniform coating over the entire length of the moving web.

The present invention provides a new and improved spray type coating apparatus for spraying paint on a moving web comprising liquid film forming boards disposed on both sides of the vertically moving web adjacent the both edges thereof, a plurality of paralled protrusions located on said boards and extending in a direction parallel to the direction of movement of the web, and liquid supplying means for dispensing a film of liquid downwardly over the surface of said boards for removing overspraying liquids on opposite surface of the belt.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
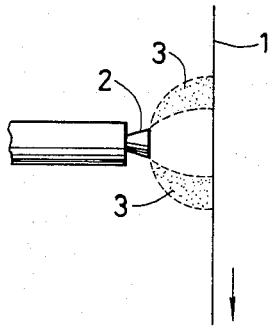
FIG. 1 is a schematic side elevation view showing a general electrostatic coating method.
Figure 2:
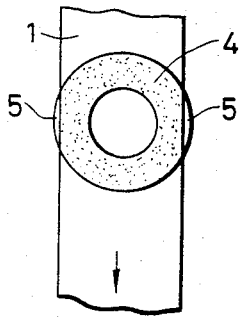
FIG. 2 is a front elevation view showing the coating pattern provided the method of FIG. 1.

Referring to FIGS. 1 and 2, it is seen that the spray coating apparatus illustrated in FIG. 1 provides a ring-shaped coating pattern 4. In order to provide a uniform thickness coating on the moving web 1 it is necessary to dimension the ring-shaped pattern 4 so that the diameter thereof is substantially greater than the width of the belt. Thus, an overspray area 5 is formed on both sides of the belt.

Figure 3:
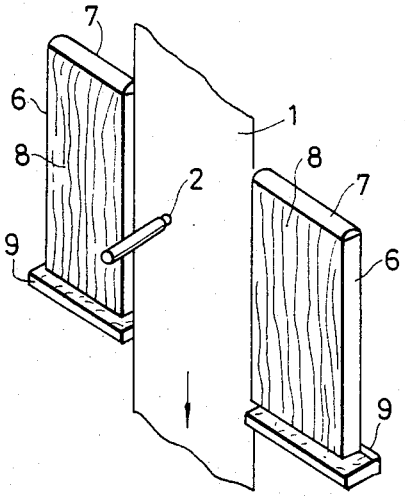
FIG. 3 is a perspective view showing an embodiment of the present invention.
Figure 4:
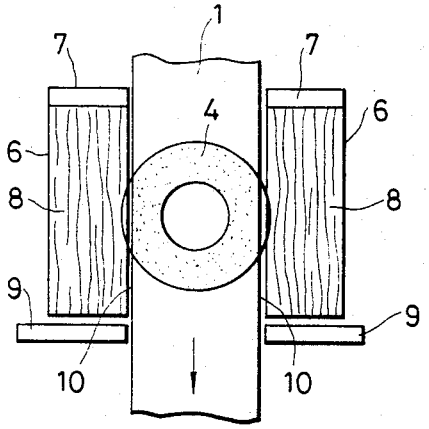
FIG. 4 is a front elevation view of the apparatus according to the present invention showing the coating pattern.

According to the present invention, as seen in FIGS. 3 and 4, a pair of liquid film forming boards 6 are located along both edges of the web 1, respectively. A liquid supply unit 7, which will be explained in detail hereinafter, is provided with a plurality of liquid discharging outlets along a lower edge thereof and is located on top of each board 6. A liquid supplied from the liquid supply unit 7 forms a liquid film 8 on each board 6 which flows down the liquid filming board to intercept the oversprayed liquid so as to continuously remove the oversprayed liquid. The liquids flowing down the board 6 are received by any suitable receptacle 9 located at the bottom of each plate for subsequent disposal by suitable means.

Water or a solvent such as a conventional paint thinner may be used as the liquid for forming liquid films 8 which flow down the boards 6 from the supply unit 7. When the coating solution which is sprayed on the web 1 is a water base paint, water can be used as the liquid film flowing down the boards. When the coating solution is a solvent-based paint, a solvent such as a conventional paint thinner may be used as the liquid. The formation of such liquid films which flow down the surfaces of the boards 6 located on both sides of the web 1 is extremely effective in preventing the build up of coating material along the edges of the web as well as preventing the flow of coating material to the rear surface of the belt.

Figure 5:
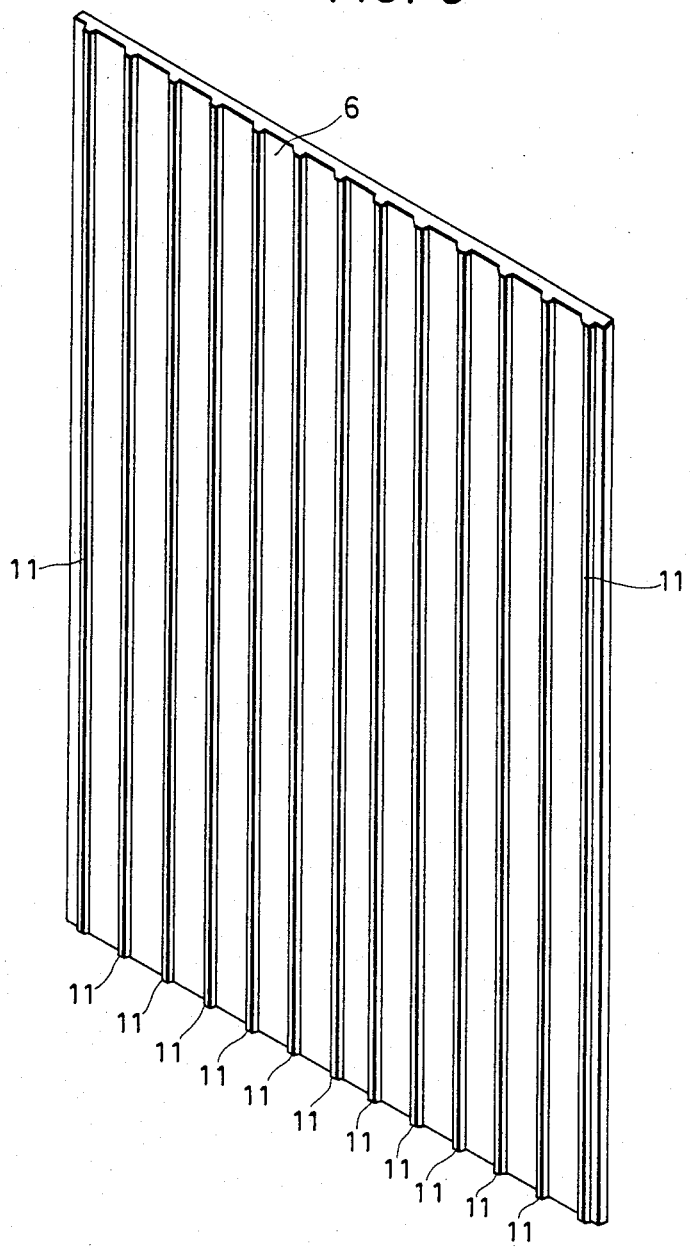
FIG. 5 is a perspective view of a liquid forming board having parallel protrusions.
Figure 6:
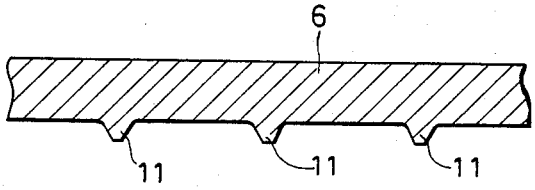
FIG. 6 is a sectional view of the liquid forming board with the parallel protrusions.

As illustrated in FIG. 5, a plurality of elongated protrusions 11 are formed on the surface of each liquid forming board 6 in such a manner that they extend parallel to the direction in which the liquid film flows down the board. A cross sectional view of the protrusion 11 is best seen in FIG. 6. The protrusions 11 are trapezoidal in cross-section, but the configuration of the protrusions is not limited to such a configuration. For example, the protrusions 11 may have a semi-circular cross-section. A cleaning liquid supplied to each liquid supply unit 7 is uniformly spread in the widthwise direction and discharged to flow evenly down each liquid filming board 6. The parallel protrusions 11 formed on the surface of the liquid filming board 6 hold the liquid therebetween which is flowing down the boards 6. The reason for this is believed to be that the interface tension between the flowing cleaning liquid and the protrusions 11 is balanced with the kinetic energy of the liquid which is flowing downwardly to thereby hold the liquid film. It is best that water be employed as the cleaning liquid flowing down the board to form the liquid film. In order to decrease the surface tension, the liquid film may be formed by using a surface active agent, water having a water-soluble organic solvent such as methanol added thereto, or an organic solvent only. Furthermore, depending on the purpose of use of the liquid film, for instance when the oversprayed paint of an organic-solvent-based paint is dissolved in the liquid film, an organic solvent such as a thinner, may be used.

Accordingly, the properties of the cleaning liquid such as composition, surface tension, viscosity and density, may be suitably changed according to the purpose of use thereof and the conditions under which it is used. It is not desirable to use an organic solvent since it may cause a fire or cause a public hazard when disposed of. The parallel protrusions 11 are formed on the liquid film forming board in such a manner that they are extended in the direction in which the liquid film flows downward. Accordingly, the cleaning liquid which is spread uniformly in the widthwise direction of the liquid supply unit 7 is regulated in direction and is prevented from moving in a direction perpendicular to the protrusions which damage the coating on the bolt adjacent thereto.

As illustrated in FIG. 3, the liquid forming boards 6 are vertically disposed so that the liquid films 8 flow down the boards 6. However, the boards 6 may be inclined depending upon the specific conditions of use. When the liquid flows at a flow rate required for forming the liquid film on an inclined surface, a liquid film thickness is provided by the interface tension between the protrusions 11 and the liquid, and the liquid film is held to the boards 6 by the force of adhesion of the liquid. Accordingly, no droplets tend to separate from the liquid film. Thus, an inclined board operates satisfactorily similar to the case where the board is disposed vertically.

The parallel protrusions 11 help to maintain the liquid film therebetween. Accordingly, the quantity of liquid required for forming the liquid film is considerably reduced. In addition, when the quantity of liquid required for forming a liquid film over the entire surface is supplied, it is possible to make the thickness of the liquid film at least equal to the height of the parallel protrusions 11. That is, the provision of the parallel protrusions 11 on the surface of the liquid film forming board 6 make it possible to increase the thickness of the liquid film by considerably reducing the quantity of liquid necessary to form a liquid film. Accordingly, a stable liquid film can be formed for a long period of time without any danger of the liquid splashing on the moving web.

In order to form a liquid film on a flat liquid film forming board which does not have any parallel protrusions thereon, it is necessary to supply a larger quantity of water. The quantity of water may be decreased by suitably changing the properties of the water, such as viscosity and surface tension with additives. However, if this method is employed, the equipment and additives are very expensive. Furthermore, since it is necessary to change the properties of the water at all times, it is necessary to provide suitable devices which are extremely intricate and expensive.

The parallel protrusions which extend in the direction of flow of the liquid film should have a pitch of 15 mm, preferably 10 mm or less, and a trapezoidal cross section wherein the sides have a width of 5 mm, preferably 3 mm, or less, and a height of 2 mm, preferably 1 mm or less. If the pitch and the foregoing dimensions of the protrusions are increased above the foregoing values, it is difficult to form a liquid film and it is necessary to use a large quantity of liquid to form a liquid film. Furthermore, it is extremely difficult to maintain a stable liquid film without parallel protrusions 11.

The material of the liquid film forming board 6 having parallel protrusions thereon is not particularly limited, that is, it may be constructed of metal or plastic material. However, it is desirable that the liquid forming board 6 be made of metal since it is necessary for the parallel protrusions 11 to maintain the liquid film therebetween and when the oversprayed liquid meets the liquid film in an electrostatic coating method, the supply of the liquid might be interrupted.

Figure 7:
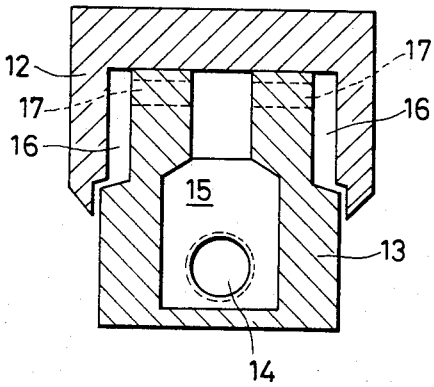
FIG. 7 is a sectional view of the liquid supplier as illustrated in FIGS. 3 and 4.

FIG. 7 discloses a sectional view of one example of a liquid supply unit 7 of the type shown in FIGS. 3 and 4. A liquid is supplied to a plenum chamber or manifold 15 through a conduit pipe 14 from a suitable liquid supply. The liquid thus supplied is introduced through the overflow holds 17 into chambers 16. Since the chambers 16 have narrow slit-type outlets, the liquid is spread uniformly in the widthwise direction. As a result, the liquid flowing down the liquid film forming boards 6 forms a liquid film between the parallel protrusions 11. The liquid supply unit 7, as illustrated in FIG. 7, is adapted to provide a liquid film on opposite sides of the liquid film forming board since the body 13 would rest on the upper surface of the board. If a liquid film is desired on only one side of the board, a modified supply unit could readily be provided. The cover 12 which mates with the body 13 of the supply unit 7 defines the slits for supplying the liquid from the chambers 16.

In order to clarify the operation of the apparatus according to the present invention, the following actual examples and comparison examples are provided.

BASIC EXAMPLE 1

A plate of SUS-304,2000 mm long and 1000 mm wide, was machined into a liquid film forming board with parallel protrusions 11 having a pitch of 8 mm and a trapezoidal cross sectional configuration wherein the lower side has a width of 1 mm, the upper side has a width of 0.5 mm, and the height of the protrusion is 0.5 mm. Water was allowed to flow down the film forming board from the liquid supply unit 7 of the type as shown in FIG. 7 in order to form the liquid film between the protrusions. As the result of the liquid film forming ability experiment, we knew that it was impossible to form the liquid film flowing down the board at the supplying rate of 2 liters per minute and that it was possible to form the stable liquid film flowing down the board at the supplying rate of 4 liters per minute.

The result was the same about the liquid film forming board of the some shape and dimensions made of gunmetal or aluminum.

ACTUAL EXAMPLE 2

Similar to the Basic Example 1, a flat plate of SUS-304 was machined into a liquid film forming board with parallel protrusions having a pitch of 8 mm and a trapezoidal cross section having a lower side width of 1 mm, an upper side width of 0.5 mm, and a height of 1 mm.

Actual electrostatic coating was tried under the conditions as follows:

| | |
|---|---|
| The running web | the aluminum web of 800 mm in width, 0.24 mm in thickness |
| The running speed of the web | 25 m per minute |
| The electrostatic coating head | bell-type |
| Coating solution | water based paint having a solid component density of 20 percent |
| The flow rate of the supplied coating solution to the coating head | 14 milli-liters per minute |
| The applied voltage to the electrostatic coating head | −90 V |
| The revolution speed of the electrostatic coating head | 21,000 r.p.m. |
| The clearance between the coating head and the running web | 300 mm |

Water was allowed to flow down the board and when supplied at a flow rate of 4 liters per minute, a stable liquid film was formed. An overspray liquid was allowed to meet the liquid film thus formed. When the flow rate was 4 liters per minute of more the distribution of the coating was such that that product in its entirety was free from defects such as a heavy coating at the edge portions with the migration of paint to the rear surface. Furthermore, the liquid film forming board was maintained in a clean condition for a long period of use.

ACTUAL EXAMPLE 3

Similar to the Actual Example 2, a flat plate of SUS-304 was machined into a liquid film forming board with parallel protrusions having a pitch of 10 mm and a trapezoidal cross section having a lower side width of 3 mm, an upper side width of 1 mm, and a height of 1 mm. Water was allowed to flow down the board and when supplied at a flow rate of 4 liters per minute it was impossible to form a liquid film. When the water was supplied at a flow rate of 6 liters per minute, a stable liquid film was formed. Similar to the previous example, an overspray liquid was allowed to meet the liquid film thus formed. When the flow rate was 6 liters per minute or more the distribution of the coating was such that that product in its entirety was free from defects such as a heavy coating at the edge portions with the migration of paint to the rear surface. Furthermore, the liquid film forming board was maintained in a clean condition for a long period of use.

COMPARISON EXAMPLE 1

Flat plates of SUS-304 2000 mm long and 1000 mm wide were machined into liquid film forming board as shown in FIGS. 3 and 4. It was tried to form liquid films by allowing water to flow through the water supply unit 7 of the type shown in FIG. 7. However, even when the water was allowed to flow at the rate of 30 liters per minute it was impossible to form the desired liquid films, more specifically, the liquid films formed were incomplete. The same difficulty occured with flat plates of aluminum.

COMPARISON EXAMPLE 2

After the flat plates of aluminum in Comparison Example 1 were subjected to a hydrophilic treatment, the same test was carried out. When the flow rate was 5 liters per minute or more, a stable liquid film was formed. However, when a liquid film was formed with a flow rate of 5 liters per minute and an electrostatic coating operation was carried out allowing the oversprayed liquid to impact upon the liquid film, the overspray liquid penetrated the liquid film, thus sticking to the aluminum surfaces subjected to hydrophilic treatment with the result it was impossible to form complete liquid films. In order to form uniform liquid films, the flow rate should be at least 30 liters per minute. In addition, in the above-described case, splashing liquid from the surface of the liquid film was observed. Accordingly, the coating apparatus had to be cleaned after being used for a relatively short period of time.

In summary, the coating apparatus according to the present invention allows the formation of a cleaning liquid film of substantially thickness while using a relatively small quantity of cleaning liquid and no drops splash from the cleaning liquid film. The liquid cleaning films are extremely stable for a long period of time, and any overspray liquids are continuously removed thereby preventing any difficulties with respect to the buildup of paint along the edge portions of the web and with respect to the paint migrating to the rear surface of the web. The coating according to the present invention is uniform in thickness both in the widthwise direction and in the running direction of the web and such coatings can be obtained not only on one surface but also on both surfaces of the web which is being coated by an electrostatic apray coating operation. Furthermore, the coating apparatus and the area around the coating apparatus are not contaminated by oversprayed liquids and the apparatus and atmosphere around the apparatus are maintained in a clean condition at all times.

While the invention has been particularly shown and described with reference to a preferred embodiment thereof, it will be understood by those in the art that various changes in form and details may be made therein without departing from the spirit and scope of the invention.

What is claimed is:

1. In a spray type coating apparatus of the type in which paint is electrostatically sprayed on a substantially vertically disposed moving web, the improvement comprising a pair of flat substantially vertically disposed boards located adjacent said web on both sides thereof with each of said boards having a plurality of parallel vertically extending protrusions thereon and a liquid supply unit on the top of said boards for providing a downwardly flowing uniform film of a cleaning liquid for removing oversprayed paint.

2. In a spray type coating apparatus as set forth in claim 1 wherein said protrusions have a pitch no greater than 10 mm, sides having a width no greater than 3 mm, and a height no greater than 1 mm.

* * * * *